US006418740B1

(12) United States Patent
Williams et al.

(10) Patent No.: US 6,418,740 B1
(45) Date of Patent: Jul. 16, 2002

(54) EXTERNAL HIGH PRESSURE TO LOW PRESSURE VALVE FOR SCROLL COMPRESSOR

(75) Inventors: John R. Williams, Bristol, VA (US); Gregory W. Hahn; Carlos Zamudio, both of Arkadelphia, AR (US); Joe T. Hill, Bristol, VA (US); Zili Sun, Arkadelphia, AR (US); Jason Hugenroth, Hope, AR (US); Thomas Barito, Arkadelphia, AR (US); James W. Bush, Skaneateles, NY (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/790,275

(22) Filed: Feb. 22, 2001

(51) Int. Cl.[7] ..... F25B 49/02
(52) U.S. Cl. ..... 62/196.3; 62/126
(58) Field of Search ..... 62/125, 126, 127, 62/129, 130, 131, 196.1, 196.2, 196.3

(56) References Cited

U.S. PATENT DOCUMENTS 5,141,407 A * 8/1992 Ramsey et al. ..... 62/196.3 X
5,167,491 A * 12/1992 Keller, Jr. et al. ..... 62/196.3 X
5,996,364 A 12/1999 Lifson et al. ..... 62/196.1
6,321,544 B1 * 11/2001 Kanai et al. ..... 62/126

* cited by examiner

*Primary Examiner*—Harry B. Tanner
(74) *Attorney, Agent, or Firm*—Carlson, Gaskey & Olds

(57) ABSTRACT

An unloader valve for a scroll compressor to selectively communicate suction and discharge is positioned outwardly of the compressor housing. In this way, the unloader valve is ideally positioned to address several system failures. As an example, loss or charge, reverse running, fan failure, etc. are all addressed in an efficient and quick manner. The unloader valve may be the normal unloader valve controlled by a system control which also selectively controls capacity. The unloader valve control is modified such that it is also operable to open the unloader valve when a system failure is detected.

6 Claims, 1 Drawing Sheet

EXTERNAL HIGH PRESSURE TO LOW PRESSURE VALVE FOR SCROLL COMPRESSOR

BACKGROUND OF THE INVENTION

This application relates to an improved unloader valve being used to address system problems in a refrigerant cycle incorporating a scroll compressor.

Scroll compressors are becoming widely utilized in refrigerant compression applications. In a scroll compressor first and second scroll members each have a base and a generally spiral wrap extending from their respective bases. The wraps interfit to define compression chambers, and one of the scroll members is caused to orbit relative to the other. As the one scroll member orbits, the size of the compression chambers decreases, compressing the entrapped refrigerant.

Scroll compressors are incorporated into refrigerant cycles such that a condenser is typically positioned downstream of the scroll compressor, and expansion valve is positioned downstream of the condenser and a evaporator is positioned downstream of the expansion valve.

Several conditions within the refrigerant cycle can cause potential damage to the scroll compressor. First, if there is a loss of charge (i.e., some of the refrigerant has leaked out) then the suction pressure of the refrigerant entering the compressor may be lower than desirable. This may cause the compressor to compress the refrigerant to a discharge pressure such that the pressure ratio between the suction and discharge pressure is undesirably high. This can result in elevated temperatures within the compressor, which is undesirable. Other conditions which may lead to undesirable conditions within a scroll compressor are a fan failure, or other failures of components in the refrigerant cycle. Many methods have been proposed for addressing these types of failures. In general, these methods have addressed a single potential failure, rather than a broad range of failures. One additional problem in a scroll compressor occurs when the compressor motor is miswired to run in reverse. A scroll compressor running in reverse will pump the refrigerant from the discharge line into the suction line. With the refrigerant leaving the suction line, a good deal of lubricant will often migrate from the compressor. All of this is undesirable.

Scroll compressors have been provided with so called "unloader" valves which selectively communicate a compressed refrigerant line to a suction line. As an example, unloader valves will often communicate the suction and discharge lines leading to and from the compressor. Typically, the unloader valve is positioned within the compressor housing.

In a few proposed compressors an unloader valve is positioned outwardly of the compressor housing to selectively communicate the suction refrigerant line to a more compressed point. These valves have typically been opened to achieve capacity control, or a reduction in the amount of refrigerant which is being compressed.

SUMMARY OF THE INVENTION

In the disclosed embodiment of this invention, Applicant positions an unloader valve outwardly of the compressor housing. The unloader valve is opened in response to a sensed refrigerant cycle failure. In this fashion, the refrigerant moving toward the compressor is supplemented by discharge refrigerant leaving the discharge port.

In a reverse rotation situation, this will allow the lubricant leaving the suction tube to be quickly returned to the discharge tube, as explained better below. In a loss of charge situation, this will provide supplemental refrigerant in addition to the lower quantity of refrigerant leading into the suction tube. This will alleviate much of the undesirable effect of the loss of charge situation. This arrangement will have benefits for many other system failures. Further, positioning the controls and the unloader valve on the exterior of the housing shell will make replacement or repair of these relatively delicate components much simpler than if they were positioned within the compressor shell.

In summary, the inventive use of an unloader valve located outside of the compressor housing combined with the inventive control provides a number of valuable benefits.

These and other features of the present invention can be best understood from the attached specification and drawing, the following of which is a brief description.

BRIEF DESCRIPTION OF THE DRAWINGS

The sole FIGURE is a schematic view of a refrigerant cycle incorporated in the present invention.

DETAILED DESCRIPTION OF A PREFERRED EMBODIMENT

Figure 1:
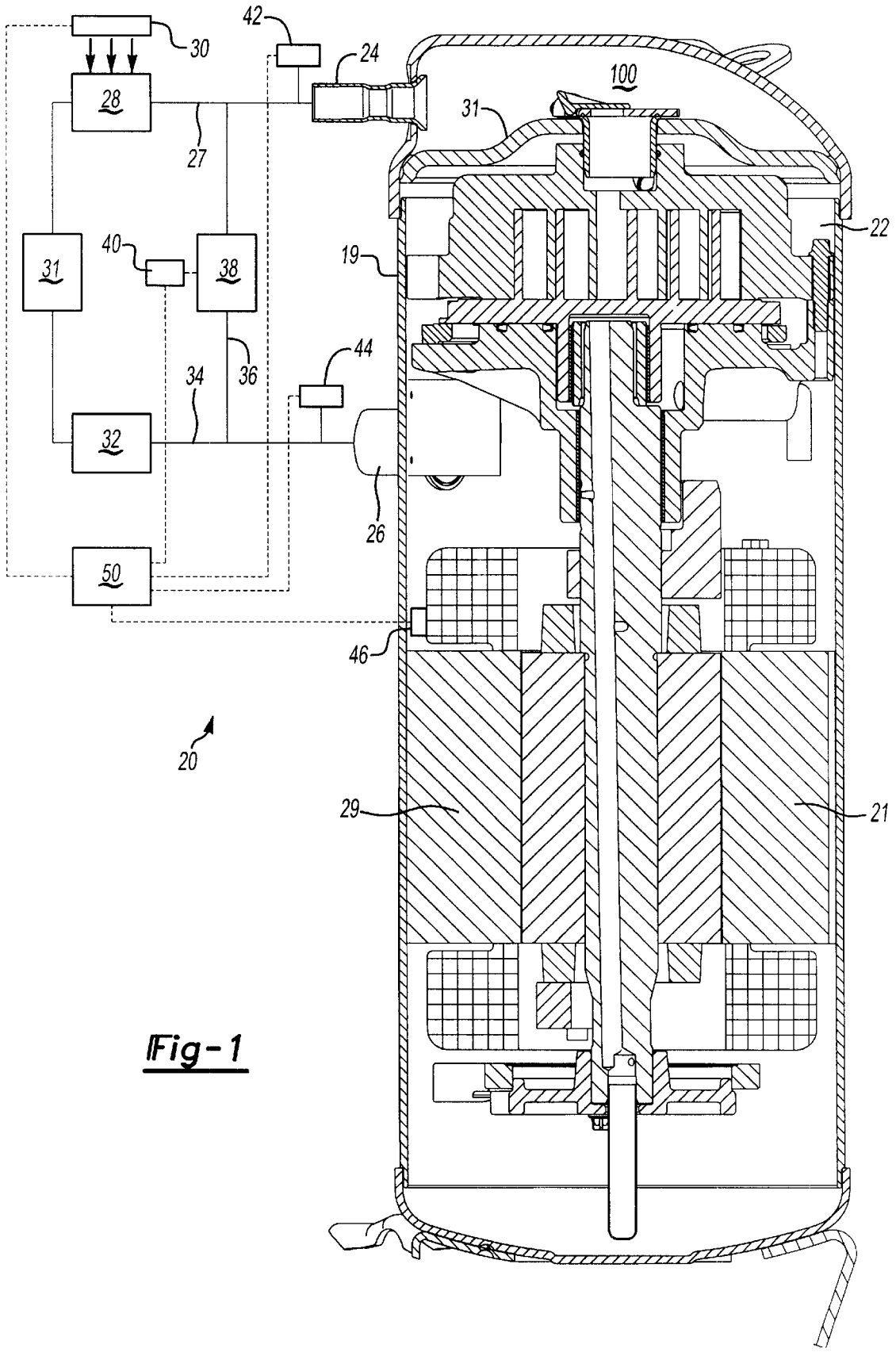

An inventive refrigerant cycle 20 is illustrated in FIG. 1 having a scroll compressor 21 with a pump set 22. A discharge port 24 and a suction port 26 are formed within the compressor housing 19, as known. As is typically known, the interior of the compressor housing 19 is sealed against fluid leakage. Suction refrigerant typically passes over the electric motor 29. Further, an upper chamber 100 communicating with the port 24 is separated from the lower chamber by a separator plate 31. As is typically known, from the discharge port 24 refrigerant passes to a condenser 28 through a passage 27. A fan 30 cools the refrigerant within the condenser 28, taking heat away from the refrigerant. The cooled refrigerant then passes to an expansion valve 31 at which it is expanded. From the expansion valve 31 refrigerant passes to an evaporator 32. The evaporator cools an environment to be cooled, and the refrigerant is again heated. From the evaporator 32 the refrigerant returns through a passage 34 to the suction port 26. This is an over simplification of a refrigerant cycle, and many more elements may be incorporated. However, for purposes of understanding this invention, the above will suffice for a description of a typical refrigerant cycle.

As shown, a bypass line 36 positioned outwardly of the housing 19 selectively communicates the lines 27 and 34. The bypass line 36 includes a valve 38 which is operable through a valve controller 40. A number of sensors such as discharge pressure sensor 42, suction pressure sensor 44, and sensor 46 associated with the motor 29 may be incorporated into the cycle. Further, the control 50 receives signals not only from sensors 42, 44 and 46, but also from the fan 30. It should be understood that the above locations of the sensors are merely exemplary. Any sensed location which can provide an indication of a failure within the refrigerant cycle may be incorporated into this invention and used to operate the valve 38 through the control 40. While the controls 40 and 50 are shown as separate, of course, they could be a single controller. Any type of controller may be utilized which is appropriate for achieving the functions of this invention as described above and below.

Now, if the ratio of the pressures at sensors 42 and 44 is higher than desired, if conditions indicate fan 30 is failing, should sensor 46 or some other sensor be indicative of the motor 29 being driven in a reverse fashion, or some other appropriate system failure be identified, valve 38 is caused to open and selectively communicate the passages 27 and 34. When the passages 27 and 34 are communicated, refrigerant flowing into the suction tube 26 is supplemented. In this way, the amount of refrigerant leading into the compressor pump set 22 will be increased, and the pressure ratio will not be as high, reducing potential damage to the compressor, or other refrigerant cycle 20 components. In the event of reverse rotation of the motor 29, selectively communicating the passages 27 and 34 will serve the opposed purpose. In driven reverse rotation, refrigerant is being drawn into discharge port 24 and driven outwardly of the suction port 26. The refrigerant leaving suction port 26 will tend to include lubricant. It is undesirable to continue to operate the compressor 21 as the amount of lubricant decreases. Thus, by connecting the lines 27 and 34, applicant provides a short circuit for the return of the lubricant, such that it is quickly brought back into the compressor 21.

While the motor control 46 is shown for detecting the occurrence of reverse rotation, many other methods of identifying a reverse rotation condition may be utilized. The sensor 46 is shown merely schematically. Often, the condition of the refrigerant at the inlet and outlet is utilized to predict reverse rotation. The unloader valve and unloader line may also be utilized for capacity control, as is the standard use of an unloader valve. Further, positioning this unloader valve and the additional controls for controlling the system failure on the exterior of the housing will simplify repair or maintenance of these controls and valves. If these components were mounted within the compressor shell, they would be more difficult to repair/maintain.

While a preferred embodiment of this invention has been disclosed, a worker of ordinary skill in this art would recognize that certain modifications come within the scope of this invention. For that reason the following claims should be studied to determine the true scope and content of this invention.

What is claimed is:

1. A scroll compressor comprising:

a first scroll member having a base and a generally spiral wrap extending from said base and a second scroll member having a base and a generally spiral wrap extending from said base;

a shaft for driving said second scroll member to orbit relative to said first scroll member and a motor for driving said shaft;

a sealed housing for enclosing said first and second scroll members, said shaft and said motor;

a suction tube for delivering a suction refrigerant into said sealed housing and a discharge tube for taking a compressed refrigerant from said first and second scroll members and delivering said compressed refrigerant to a downstream location; and a bypass line positioned outwardly of said housing and selectively communicating said discharge tube and said suction tube, and a selectively open valve on said bypass passage, said selectively open valve being provided with a control such that said valve is opened when a system failure is detected in a refrigerant cycle associated with said scroll compressor.

2. A scroll compressor as recited in claim 1, wherein suction and discharge pressure sensors are associated with said suction and discharge pressure lines and communicated to said control such that said control can identify said failures.

3. A refrigerant cycle comprising:

a scroll compressor including a first scroll member having a base and a generally spiral wrap extending from said base and a second scroll member having a base and a generally spiral wrap extending from said base, a shaft for driving said second scroll member to orbit relative to said first scroll member and a motor for driving said shaft, a sealed housing for enclosing said first and second scroll members, said shaft and said motor, a suction tube for delivering a suction refrigerant into said sealed housing and a discharge tube for taking a compressed refrigerant from said first and second scroll members and delivering said compressed refrigerant to a downstream location, and a bypass line positioned outwardly of said housing and selectively communicating said discharge tube and said suction tube, and a selectively open valve on said bypass passage, said selectively open valve being provided with a control such that said valve is opened when a system failure is detected;

a condenser positioned downstream of said bypass line, said condenser communicating with an expansion valve, said expansion valve communicating with an evaporator, said evaporator being positioned upstream of said bypass passage; and said failure being a failure of a component within said refrigerant cycle.

4. A refrigerant cycle as recited in claim 3, wherein suction and discharge pressure sensors are associated with said suction and discharge pressure lines and communicated to said control such that said control can identify said failures.

5. A method of controlling a refrigerant cycle comprising the steps of:

(1) Providing a refrigerant cycle including a scroll compressor having a suction tube leading into an enclosed housing shell, and a discharge tube leading from said shell, and a bypass line connecting said suction tube to said discharge tube outside of said shell, said bypass line including a selectively openable bypass valve, a condenser positioned downstream of said discharge tube, an expansion valve positioned downstream of said condenser and an evaporator positioned downstream of said expansion valve; and (2) Monitoring said refrigerant cycle to identify system failures, and opening said bypass valve if a system failure is identified.

6. A method as set forth in claim 5, wherein said system failure is detected by monitoring suction and discharge pressure of the refrigerant at said compressor, and making a determination of system failure based upon said monitored pressures.

* * * * *